United States Patent [19]

Hurley et al.

[11] Patent Number: 4,671,250

[45] Date of Patent: Jun. 9, 1987

[54] DIRECT-FIRING GAS CONVECTION OVEN

[75] Inventors: James R. Hurley, East Weymouth; Joseph R. Birkner, West Peabody; Maurice Nunes, Arlington, all of Mass.

[73] Assignee: Thermo Electron Corporation, Waltham, Mass.

[21] Appl. No.: 890,219

[22] Filed: Jul. 28, 1986

[51] Int. Cl.[4] ..... F24C 15/32

[52] U.S. Cl. ..... 126/21 A; 126/39 R; 99/447

[58] Field of Search ..... 126/21 A, 39 R, 39 E, 126/39 K, 21 R, 275 R; 99/447, 474; 432/176, 194

[56] References Cited

U.S. PATENT DOCUMENTS

| | | | |
|---|---|---|---|
| 3,118,436 | 10/1964 | Keating | 126/19 |
| 3,384,068 | 5/1968 | Perry et al. | 126/21 A |
| 3,698,377 | 10/1972 | Smith | 126/21 A |
| 3,710,775 | 1/1973 | Tamada et al. | 126/21 A |
| 3,719,180 | 3/1973 | Pere | 126/21 A |
| 3,973,551 | 8/1976 | Caselani et al. | 126/21 A |
| 3,991,737 | 11/1976 | Del Fabbro | 126/21 A |
| 4,108,139 | 8/1978 | Gilliom et al. | 126/21 A |
| 4,373,504 | 2/1983 | Day | 126/21 A |
| 4,467,777 | 8/1984 | Webeo | 126/21 A |
| 4,484,561 | 11/1984 | Baggott et al. | 126/21 A |
| 4,498,453 | 2/1985 | Ueda | 126/21 A |
| 4,516,012 | 5/1985 | Smith et al. | 126/21 A X |
| 4,591,333 | 5/1986 | Henke | 126/21 A X |

*Primary Examiner*—Randall L. Green

*Attorney, Agent, or Firm*—Herbert E. Messenger

[57] ABSTRACT

An efficient, low cost, gas-fired convection oven is disclosed. The oven includes a burner, such as a ceramic induced draft/boosted burner with premixed pressurized air/fuel gas supply, which fires combustion products through an opening in a baffle directly into a convection blower. The blower assembly, protected by a shield/deflector structure, also draws gases from a cooking chamber around the burner to mix with combustion products in a blower chamber. Action of the blower directs the mixture through the blower to circulate through gaps formed by the top and bottom of the baffle and into the cooking chamber. The oven avoids complex, costly wall-type heat exchangers, has no combustion chamber, and provides efficient, uniform cooking in a unit of low manufacturing cost.

13 Claims, 5 Drawing Figures

DIRECT-FIRING GAS CONVECTION OVEN

BACKGROUND OF THE INVENTION

This invention relates to convection ovens and particularly to gas-fired convection ovens employing recirculation of oven gases and burner combustion products.

Demand for convection ovens in the food service industry has increased substantially in the past ten years. Both gas-fired and electrically-powered units are available, and are used to cook a variety of foods such as cakes, pies, chickens, potatoes, and other foods. Even though performance of these two types has been relatively equal, electric convection ovens have enjoyed a considerably larger market share due to their lower selling price. The price advantage, which may exceed sixty percent, is due to the higher manufacturing costs of items such as side-mounted heat exchangers and combustion systems typically employed in gas-fired convection ovens.

One gas-fired convection oven of the recirculating type is disclosed in U.S. Pat. No. 4,108,139. That oven includes a mixing chamber which receives the combustion products of a burner and bottom outflow air collected from an oven cavity. The combined outflow of the mixing chamber is delivered to a blower and circulated back to the oven cavity through holes in a top manifold.

Other gas-fired convection ovens are shown in U.S. Pat. Nos. 3,710,775; 3,991,737; and 4,467,777. The first of these discloses an oven with a bottom-mounted burner whose combustion products travel in a duct to enter the lower portion of a hole in a partition plate ahead of a blower. Gases from the oven cavity enter the upper portion of the partition plate hole, and the blower recirculates the combined gas flow to re-enter the oven cavity through its front and sides.

In U.S. Pat. No. 3,991,737 a convection oven is described which includes an atmospheric gas burner in a combustion chamber in back of a blower which recirculates heated air through perforated side wall baffles. Gas flows are channeled in a manner such that as combustion products pass through a duct to the front of the blower to combine with oven gases they entrain a portion of gases flowing towards the oven exhaust.

The convection oven of U.S. Pat. No. 4,467,777 includes a rear-mounted burner which fires through a nozzle block in a forward direction towards a baffle which deflects combustion products back towards four blowers adjacent to the burner. Other baffles direct gases from the oven cavity to the blower inlet and direct gases exiting the blower to the front of the oven cavity.

While the above-referenced convection ovens and others currently in use provide certain advantages associated with recirculation, their structures are relatively complex and thus costly to manufacture. The prior art ovens also do not provide the temperature uniformity and level of efficiency desired in cooking certain foods.

Accordingly, it is an object of the present invention to provide an improved, low-cost gas-fired convection oven.

It is also an object of the invention to provide a high efficiency, gas-fired convection oven which produces cooking gases of uniform temperature distribution during operation.

It is a further object of the invention to provide a gas-fired convection oven which is easy to clean and service.

It is also an object of the invention to provide a compact, fuel-efficient gas-fired convection oven which operates without high external wall temperatures.

It is also an object of the invention to provide a direct gas-fired convection oven of the recirculating type of simple construction which does not require a combustion chamber or side wall heat exchanger.

SUMMARY OF THE INVENTION

The invention is an improved, gas-fired convection oven which provides efficient, uniform cooking in a simple unit which is inexpensive to manufacture. The low-cost oven utilizes a burner which fires directly into a recirculating blower assembly, thereby avoiding the need of a combustion chamber and wall-type heat exchangers.

In the convection oven of the invention, an oven cavity formed by walls is divided by a vertical baffle into a cooking chamber and a blower chamber. The baffle has an opening, such as a centrally located circular hole, through which a burner directs combustion gases into the blower chamber. Spaces between the baffle and oven walls provide return passages for recirculation into the cooking chamber of a mixture of combustion gases and cooking gases which have been drawn into the blower chamber. The burner, which preferably utilizes a premixed flow of air and fuel gas pressurized by a combustion blower, operates without a combustion chamber and fires combustion gases directly into a blower assembly. A convection blower or fan of the blower assembly faces the burner and operates to draw cooking gases around the burner into the blower chamber where they immediately mix with combustion gases. The fan then returns the mixed gases to the cooking chamber through passages such as gaps between the baffle and the top and bottom walls of the convection oven. A flue vent permits a portion of the gases to exhaust from the cooking chamber.

The blower assembly of the oven also preferably includes a bowl-shaped shield or deflector mounted on the end of the fan drive shaft facing the burner. The shield protects the shaft and adjacent areas from high temperature combustion gases and also is shaped to deflect gases radially outward for passage between the blades of the fan.

Key advantages of the convection oven of the invention include low manufacturing cost, high efficiency, compact size, and uniform temperature and heat distribution. The oven also provides low external wall surface temperatures and reduced heat load to areas surrounding the oven. Moreover, the oven is easy to service and maintain.

DESCRIPTION OF PREFERRED EMBODIMENTS

Figure 1:
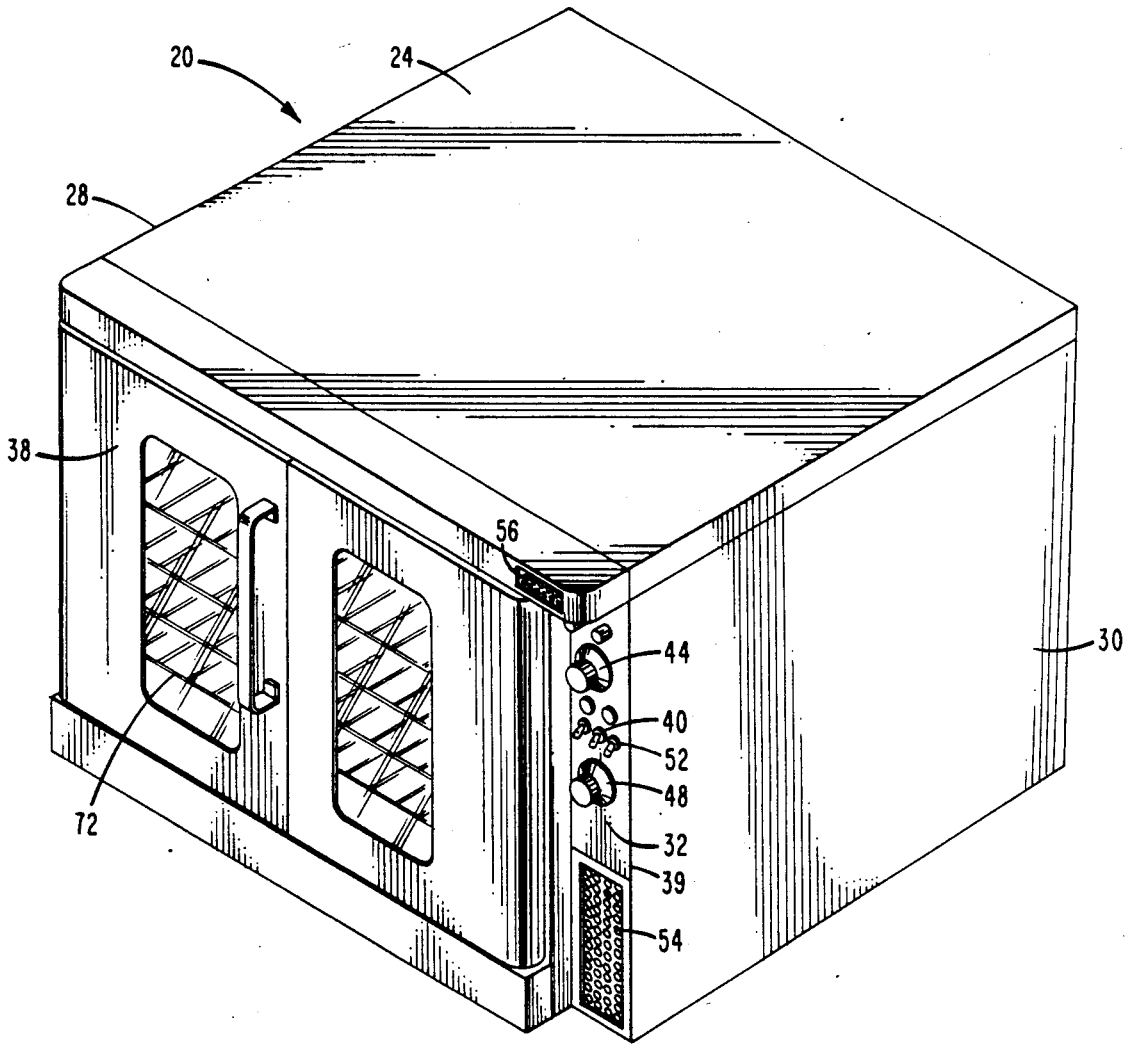
FIG. 1 is a perspective view of a convection oven in accordance with the invention, with portions broken away to expose internal details.
Figure 2:
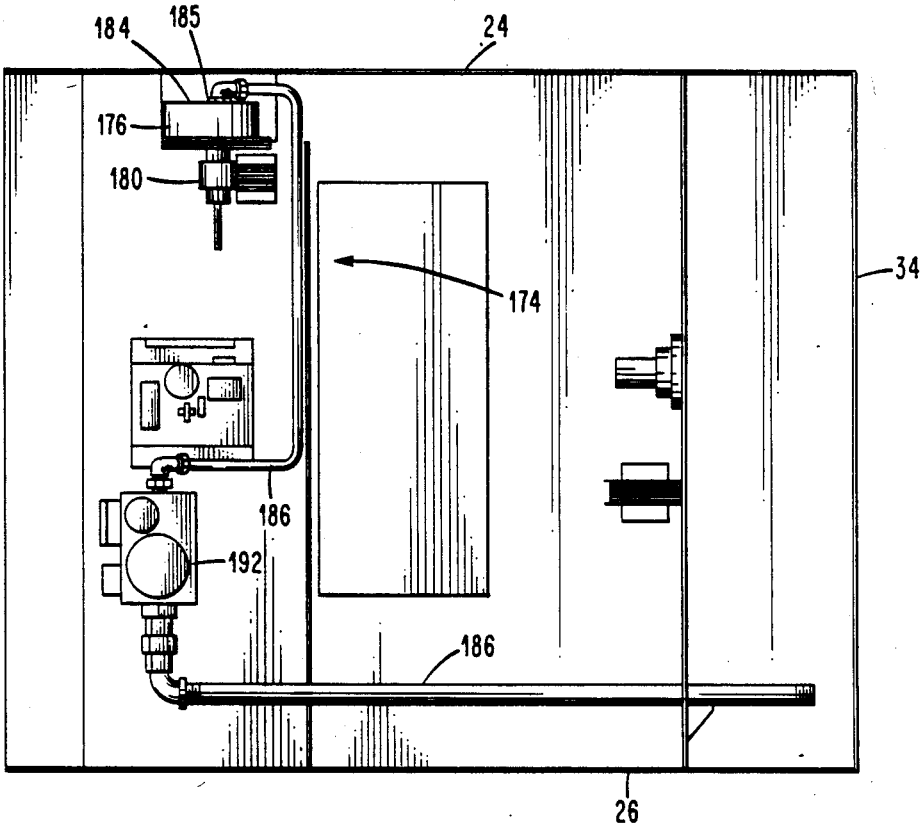
FIG. 2 is a side elevation view of the oven.

With reference to the drawings, in which the same numerals designate like parts in each figure, a preferred gas convection oven 20 is formed of a box-like housing (FIG. 1) with insulated walls including top and bottom walls 24 and 26, side walls 28 and 30, a front wall 32, and a rear wall 34. A pair of doors 38 attached to the front wall 32 permit loading of food into, and its removal from, the oven 20. Also mounted on the front wall 32 is a control panel 39 through which extend controls including a power switch 40, a temperature control 44, a timer 48, and a light switch 52. A lower portion 54 of the control panel 39 is perforated to admit air at room temperature for cooling of these controls, and a perforated upper portion 56 of the panel admits air to supply a combustion blower in the oven 20 as described in detail below.

The enclosed oven cavity formed by the housing 22 is divided by a generally vertical baffle 60 (FIG. 4) into a cooking chamber 62 in which food is processed and a blower chamber 66 located near the rear of the oven.

The cooking chamber 62 includes a burner assembly 70 mounted near the baffle 60 and preferably also accommodates several generally horizontal racks or shelves 72 (FIG. 1) for supporting trays of food. For removal of exhaust gases from the cooking chamber 62, the top wall 24 has a flue passage 74 formed therein which extends from an inlet opening 78 near the front portion of the top wall 24 to the rear of the oven 20 where a suitable exhaust duct (not shown) may be connected to the oven.

In the embodiment of the invention illustrated in FIGS. 1–5, the baffle 60 extends essentially entirely across the width of the oven cavity and is clipped or otherwise attached to the side walls 28 and 30. The baffle 60 is, however, spaced from the top wall 24 and the bottom wall 26 to form baffle gaps 86 and 88, respectively. The gaps 86 and 88, typically about one-half to one and one-half inches in height, permit recirculation of gases from the blower chamber 66 to the cooking chamber 62 as described in more detail hereinafter.

Also provided in a generally central portion of the baffle 60 is a hole or opening 78 through which gases may be directed into the blower chamber 66. These gases include both the output of the burner assembly 70 mounted near the opening 92 and "cooking" gases drawn from the cooking chamber 62 around the burner 70 and into the blower chamber 66.

Figure 4:
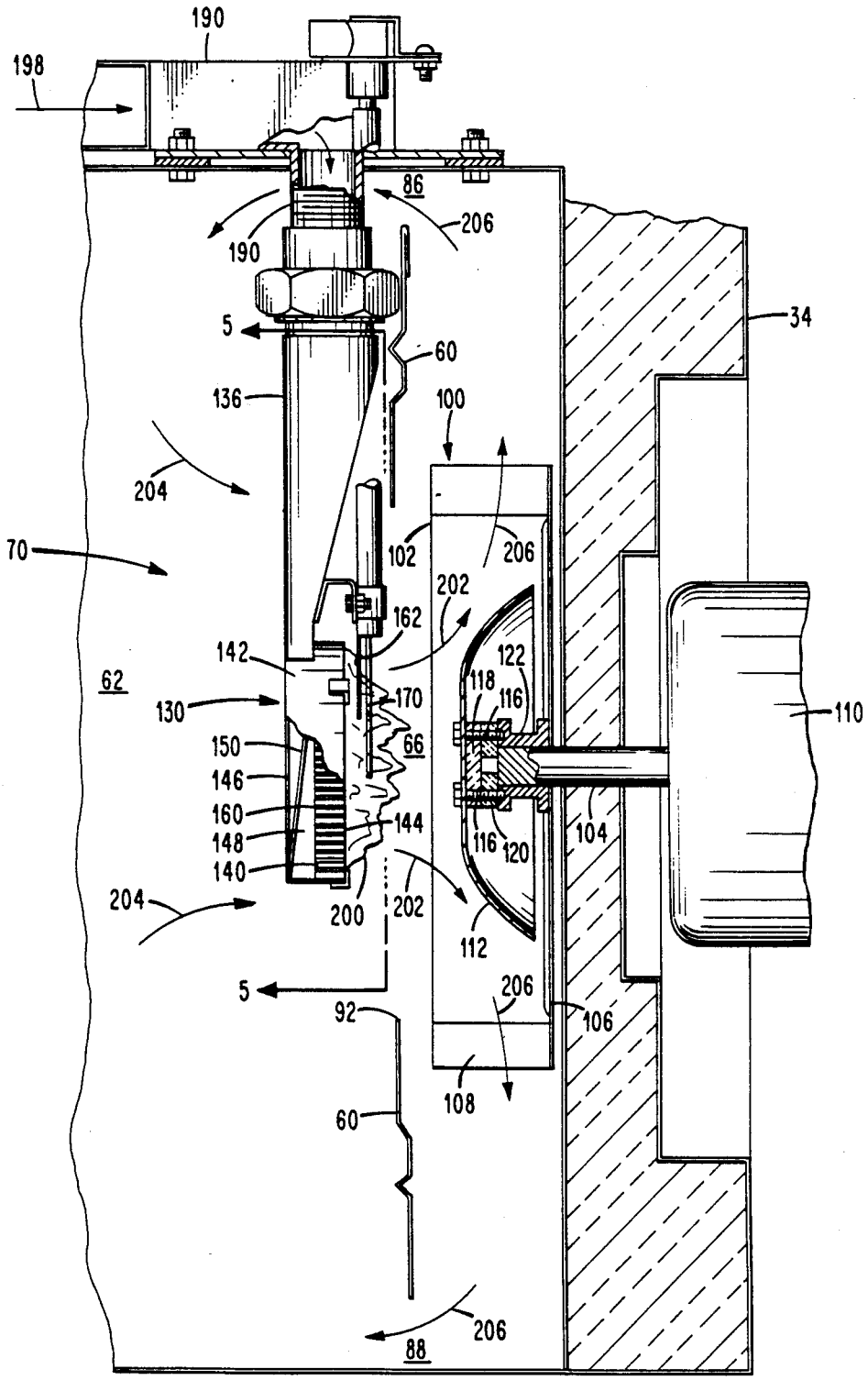
FIG. 4 is a side elevation view of a portion of the oven sectioned along the line 4—4 of FIG. 3.
Figure 5:
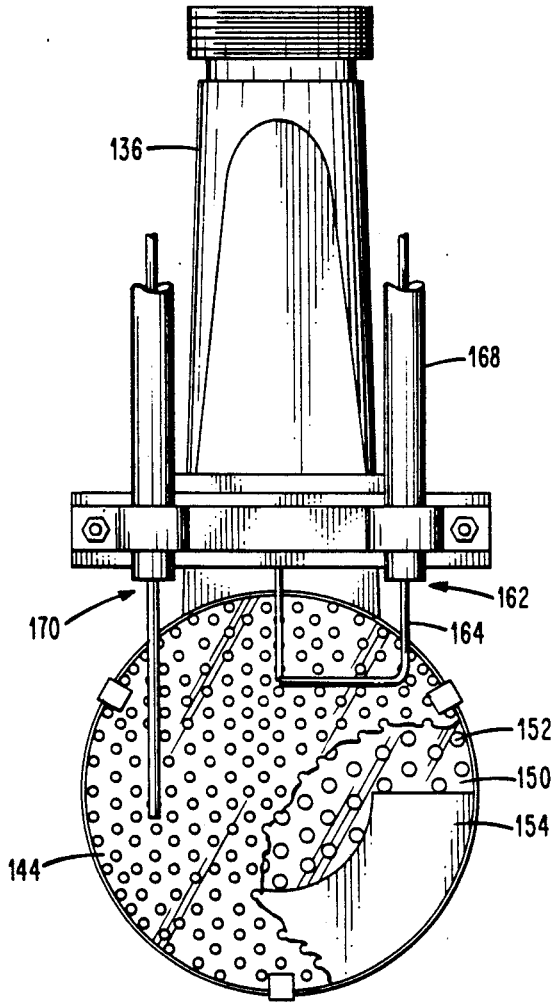
FIG. 5 is an end view of a burner of the oven taken along the line 5—5 of FIG. 3.

As best shown in FIG. 4, a blower assembly 100 is provided in, or partially within, the blower chamber 66 to mix and recirculate gases for cooking. The blower assembly 100 includes a convection blower or fan 102 mounted on a shaft 104 extending through the rear wall 34, the fan 102 preferably being of the centrifugal type comprising a wheel 106 having a ring of impeller blades 108 positioned at a radius equal to or slightly greater than the radius of the baffle opening 92. During operation, the fan 102 acts to draw gases into the blower chamber 66, to rapidly mix combustion gases and cooking gases, and then to recirculate the mixture through the gaps 86 and 88 to the cooking chamber 62.

Also included in the blower assembly 100 are a motor 110 and a shield 112 located at opposite ends of the shaft 104. The motor 110, which is preferably positioned outside the rear wall 34 of the oven, drives the shaft 104 and associated fan 102. The shield, preferably a lightweight, bowl-shaped structure of stainless steel or other heat resistant material, serves to protect the shaft 104 and adjacent areas from high temperature combustion products received in the blower chamber 66 from the burner assembly 70. It also functions, by virtue of its shape, to help direct combustion products and cooking gases radially outward towards the fan blades 108. A preferred attachment for the shield 112 comprises bolts 116 which extend through a flattened front portion of the shield 112, then through layers 118, 120 of hard insulation, and into a steel adapter 122 secured to the end of the shaft 104.

The burner assembly 70 (FIGS. 4 and 5) includes a burner 130 mounted in the rear of the cooking chamber 62 adjacent to the baffle opening 92 and centered generally in line with the shaft 104 and the shield 112 of the blower assembly 100. The burner 130 is preferably an induced draft/boosted burner which burns a pressurized mixture of air and fuel gas (such as natural gas) supplied to it through a transition duct 136 to which the burner is attached. The term "induced draft/boosted" refers to the combination of drawing action or induced draft provided by the blower assembly 100 which faces the burner 130 and the use of a pressurized air/fuel gas mixture to power the burner 130. A suitable burner 130 includes a perforated ceramic element 140 mounted within a burner shell 142 which encloses all but the circular front face 144 of the element 140. Between the element 140 and the solid back 146 of the burner shell 142 there is formed a burner plenum 148 which receives the air/fuel gas mixture from the transition duct 136. Also included in the burner 130 are a disk-shaped baffle 150 with perforations 152 which extends diagonally across the plenum 148 and a solid baffle blockout piece 154 which covers a portion of the baffle 150. The baffle 150 and blockout piece 154 help regulate and promote a uniform distribution of gases to the burner element 140.

The perforated ceramic burner element 140 functions primarily as a "blue flame" type of burner and as a flow guide to direct combustion gases through the baffle opening 92 into the blower chamber 66. It is not intended, nor does it serve, to transfer substantial amounts of heat by radiation. A preferred element 140 for the oven 20 of the invention is a disk-shaped portion of Part No. 1495 available from Hamilton Porcelains Ltd. of Ontario, Canada and having an open area of about 35 percent formed by perforations 160. Other ceramic elements may be used, and as an alternative to the element 140, but a somewhat higher cost, a metal ribbon structure may be employed in the burner assembly 70.

Ignition of the air/fuel gas mixture which is supplied to the burner element 140 is accomplished by activation of an igniter 162 which is connected to the temperature control 44 of the oven 20. A preferred igniter, which is positioned between the front face 144 of the burner element 140 and the baffle opening 92, comprises an electrode 164 shielded over a major portion of its length by a hollow porcelain rod 168 through which the electrode 164 extends. A flame sensor 170 may also be provided near the igniter 162 to verify ignition of the air/fuel gas mixture. Another suitable igniter is a silicon carbide glow coil.

In the preferred oven 20 illustrated in FIGS. 1–5 the burner 130 burns a pressurized mixture of air and fuel gas supplied by a premix assembly 174 (FIGS. 2 and 3) positioned in the upper right front portion of the oven 20 as viewed from the front. The premix assembly 174 includes a combustion blower 176 driven by an electric motor 180, and which functions to mix and pressurize air and fuel gas supplied to it. For this purpose the upper face 184 of the blower 176 has a central opening 185 for admitting fuel gas from a fuel line 186 and an array of openings 188 surrounding the central opening 185 for drawing combustion air into the blower 176. The outlet of the blower 176 is connected to a fuel/air flow tube 190 which extends diagonally across the oven 20 within the top wall 24 and then down into the cooking chamber 62 where the tube 190 is attached to the transition duct 186 of the burner assembly 70.

Activation of the premix assembly 174 is accomplished by means of the power switch 40 on the front wall 32 of the oven which is connected to the electric motor 180. Also, a valve 192 in the fuel line 186, such as a solenoid valve electrically connected to the temperature control 44, regulates flow of fuel gas to the blower 176.

As is evident in FIG. 4, no combustion chamber is provided in the oven 20 of the invention, which reduces cost ansd saves space in the oven. During operation of the burner 130, flames are stabilized on or near the burner element 140 and combustion products from the burner are fired directly into the blower assembly 100. The resulting gas mixture, which typically has a temperature of about 25°–50° F. above the desired temperature of the cooking gases, is circulated by the convection blower 102 through the gaps 86 and 88 and back to the cooking chamber 62 to provide even, efficient cooking of foods therein. A portion of the cooking gases are continually exhausted from the chamber 62 through the flue passage 74 in the top wall 24. A valve, not shown, may be included in the flue passage 74 or exhaust duct to help regulate the flow of gases through the exhaust duct.

Figure 3:
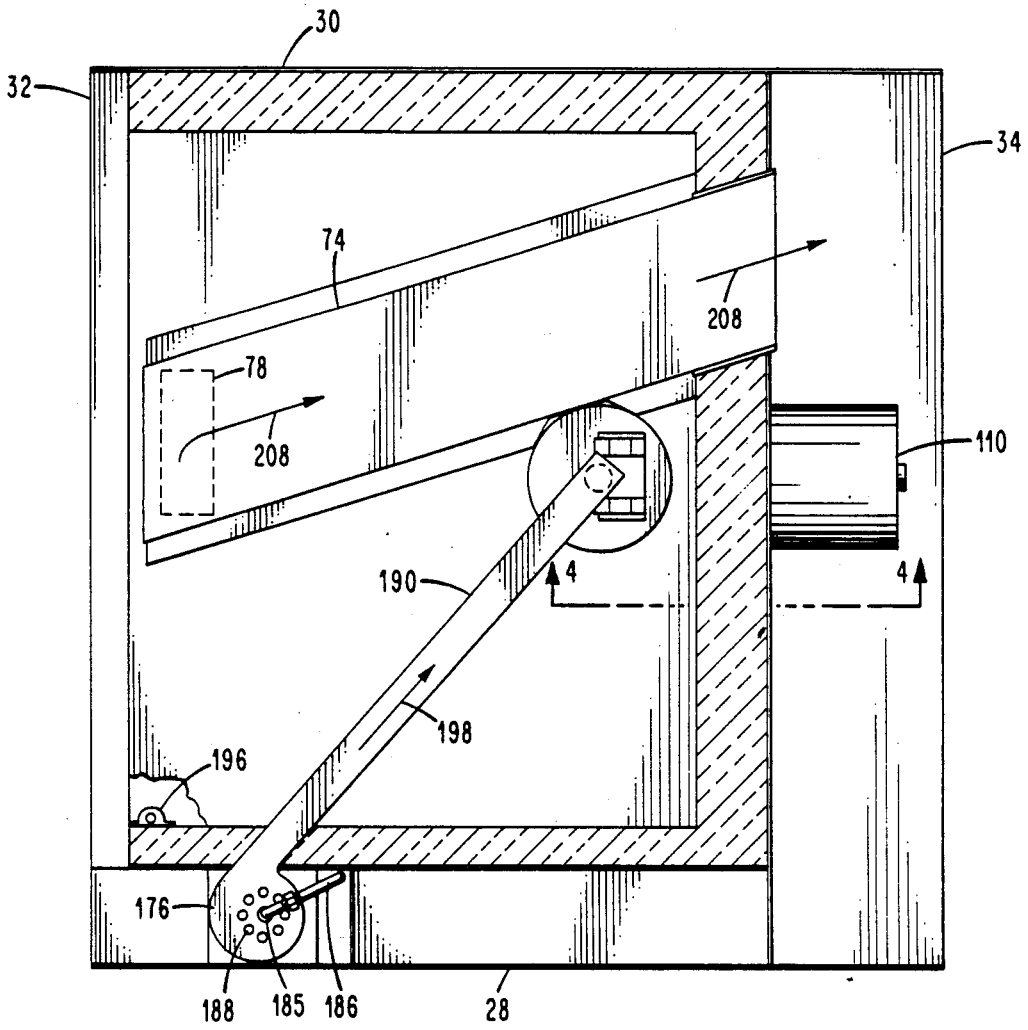
FIG. 3 is a top view of the oven sectioned along the line 3—3 of FIG. 2.

To operate the oven 20, the power switch 40 is turned on, activating the fan 102 of the blower assembly 100 which continues to rotate as long as the switch 40 remains in an "on" position. The temperature control 44, which is electrically connected to a suitable thermostat 196 in the cooking chamber 62, may then be set to a desired cooking temperature. Setting of the temperature control 44 to a temperature above that sensed by the thermostat 196 activates the combustion blower 176 and the igniter 162, and the fuel gas valve 192 opens when the pressure drop across it falls to a preset level. Air drawn into the combustion blower through the openings 188 mixes with fuel gas entering under line pressure through opening 185 and a pressurized fuel/air mixture is formed. As is indicated in FIGS. 3 and 4, the fuel/air mixture 198 passes along the tube 190 in the top wall 24 of the oven, down through the transition duct 136 into the burner plenum 148, and through the perforations 160 of the burner element 140 where it is ignited, producing flames 200 which stabilize on or near the element 140. Combustion products 202 are directed through the baffle opening 92 into the blower chamber 66 where they rapidly mix with gases 204 drawn into the chamber 66 from the cooking chamber 62 around the burner shell 142. The mixture 206 is deflected and drawn outward through the impeller blades 108 of the fan 102 and is returned to the cooking chamber 62 through the gaps 86 and 88, and a portion leaves as exhaust 208 through the flue passage 74. When the gas temperature in the cooking chamber 62 attains the desired preset level, action of the thermostat 196 shuts off the combustion blower 176 and thus the flow of fuel gas and combustion air to the burner 130. The premix assembly 174 and the burner 130 thereafter cycle to maintain the desired cooking temperature for the period set on the timer 48.

Test were conducted to compare the performance of the oven of the invention and that of prior art commercial ovens, both gas-fired and electrically-powered. Two improved ovens were tested, one with a glow coil for ignition and the other with spark ignition. Included were tests to compare actual energy input with rated input, flue losses (gas-fired ovens only), and heat-up and stand-by characteristics. Calorimeter tests were also performed wherein a fixed amount of water was boiled in the ovens, with steam vented to the atmosphere.

Results of the tests, summarized in Table 1, show that the gas-fired oven of the invention performed substantially better than the prior art gas-fired ovens tested and at levels closer to the electrically-powered oven than to the other gas ovens. The improved oven demonstrated substantially lower flue losses, lower heat-up times, and lower stand-by consumption than the prior art gas-fired ovens tested. Colorimetric efficiencies of the improved gas-fired oven were a full sixteen to nineteen percentage points higher than those of the prior art gas ovens. It should also be noted that both prior art gas-fired ovens were appreciably larger in physical dimensions than the compact, improved oven of the invention.

Bake tests were also performed on cakes, cookies, potatoes, frozen pies, and other foods. Results indicated better baking with the oven of the invention, particularly with regard to uniformity of cooking achieved.

The oven of the invention, in adition to offering the above-indicated performance benefits, also operates with lower wall surface temperatures than other commercial ovens, providing greater operator safety and comfort. Typical temperatures measured on the top wall 24 and front wall 32 of the present oven during operation (at a cooking gas temperature of about 450° F.) were 72°–88° F. as compared with surface temperatures of 75°–150° F. for gas oven 2 of Table 1.

TABLE 1

OVEN PERFORMANCE COMPARISON

| | PRIOR ART OVENS | | | IMPROVED GAS OVENS | |
|---|---|---|---|---|---|
| | GAS OVEN 1 | GAS OVEN 2 | ELECTRIC OVEN | W/GLOW COIL | W/SPARK |
| Rated Input (BTU/Hr) | 55,000 | 60,000 | 11.0 KW | 45,000 | 45,000 |
| Measured Input (BTU/Hr) | 52,000 | 61,200 | 10.3 KW | 45,000 | 47,500 |
| Flue Loss (%) | 32 | 33 | — | 21 | 19 |
| Heat-Up* Time (MIN) | 20.8 | 17.2 | 12.8 | 11.9 | 11.6 |
| Heat-Up** Gas Consumption (BTU) | 18,000 | 17,600 | 7,500* | 8,900 | 9,200 |
| Stand-by*** Gas Consumption (BTU) | 13,250 | 14,200 | 4,700* | 7,300 | 7,400 |
| Calorimeter Test | 17,600 | 16,600 | 8,800* | 10,400 | 10,600 |

TABLE 1-continued

| OVEN PERFORMANCE COMPARISON | | | | | |
|---|---|---|---|---|---|
| | PRIOR ART OVENS | | | IMPROVED GAS OVENS | |
| | GAS OVEN 1 | GAS OVEN 2 | ELECTRIC OVEN | W/GLOW COIL | W/SPARK |
| Gas Consumption (BTU) Calorimeter Test Efficiency (%) | 27.5 | 30.0 | 55.2 | 46.7 | 45.9 |

*Equivalent electric energy.
**To 450° F.
***One hour at 400° F.

The oven shown in FIGS. 1–5 and described to this point is a preferred embodiment; however, several other embodiments are possible within the scope of the present invention. For example, an induced draft/atmospheric gas-fired burner may be employed in place of the induced draft/boosted burner illustrated herein, and the improved oven of the invention has yielded good performance when tested with a burner of this type. In an oven utilizing an induced draft/atmospheric burner, air and fuel gas typically mix and flow to the burner 130 from the bottom or side of the oven 20, with the convection blower 102 providing suction to draw both burner combustion products and cooking gases into the blower chamber. Because no combustion blower is used, an induced draft/atmospheric burner would further reduce the cost of the oven. However, ovens with the induced draft/boosted burner have been found to have somewhat better operating performance at high levels of heat input (above 40,000 BTU/hr) than ovens utilizing an induced draft/atmospheric burner.

Changes may also be made to the combustion blower 176 and/or the convection blower 102 of the oven 20. With a suitable motor speed controller coupled to the motor 180 of the combustion blower 176 and, in turn, preferably controlled through a microprocessor, the flow of air/fuel gas mixture to the burner 130 may be varied while maintaining a desired ratio of air flow and fuel gas flow. In this way the output of the burner 130 may be varied so as to reduce the amount of cycling of the burner and/or achieve finer control of temperature of the cooking gases. If a constant air/fuel gas ratio is to be maintained, it may also be desirable to provide means for varying the size of the openings 185 and 188 admitting air and fuel gas to the combustion blower 176—for example, a rotatable orifice plate with openings matching the openings 185 and 188 may be mounted on the upper face 184 of the combustion blower 176. In addition to (or instead of) the motor speed controller connected to the motor 180, a motor speed controller may be connected to the motor 110 of the convection blower 102 (or a single controller may be linked to the motors of both blowers 102 and 176) so as to vary the recirculation of combustion products and cooking gases to the cooking chamber 62. The variation of speed of the convection blower 102 may be particularly useful in the baking of different types of foods—for example, low cooking gas flow rates may result in improved quality for delicate products such as chiffon pies and souffles. Baking tests during which different speeds of the convection blower were utilized have demonstrated improved uniformity of cooking.

Yet another variation applicable to the oven of the present invention is the substitution, for the centrifugal fan illustrated in FIGS. 1 and 4, of a radial fan with appropriate controls for reversing the direction of fan rotation. Periodic reversal of fan rotation—for example, from one to about four times per minute—would "even out" any non-uniformities in the flow pattern of recirculating gases and thus provide even greater uniformity of cooking of food products in the cooking chamber 62.

Accordingly, there has been shown and described an improved gas-fired convection oven of simple, inexpensive construction which does not require side wall heat exchangers or a combustion chamber. The oven provides fast start-up, efficient, uniform cooking of food products, and avoids excessive wall temperatures.

The forms of the improved oven shown and described herein are preferred embodiments and changes may be made therein without departing from the spirit or scope of the invention. The invention is defined as all embodiments and their equivalents within the scope of the claims which follow.

What is claimed is:

1. A gas-fired convection oven comprising:

walls forming an enclosed oven space, said walls including top and bottom walls, two opposed side walls, a rear wall, and a front wall;

a baffle dividing said enclosed space into a cooking chamber and a blower chamber, said baffle having a first opening for flow of gases from said cooking chamber to said blower chamber and defining at least one second opening for flow of gases from said blower chamber to said cooking chamber;

a blower assembly extending into said blower chamber and operable to draw cooking gases from said cooking chamber into said blower chamber for recirculation;

a burner positioned near said first opening of the baffle and facing said blower assembly, said burner shaped and positioned to permit said cooking gases to be drawn around said burner and through said first opening of the baffle, and being operable to fire combustion products directly through said first opening into said blower assembly;

said blower assembly being further operable to direct a mixture of said combustion products and said cooking gases through said second opening; and means for delivering a premixed supply of air and fuel gas to said burner.

2. A convection oven as in claim 1 wherein said blower assembly includes:

a shaft;

a fan connected to said shaft within said blower chamber;

means for rotating said shaft;

a rotatable deflector connected to the end of said shaft within said blower chamber and aligned with said burner, said deflector operable to protect portions of said blower assembly from direct exposure to the combustion products of said burner; and means for insulating said deflector from said shaft.

3. A convection oven as in claim 1 wherein said baffle comprises a plate substantially parallel to said rear wall, the top and bottom edges of said baffle being spaced from the top and bottom walls, respectively, of said oven to form two said second openings for flow of said mixture of combustion products and said cooking gases from said blower chamber to said cooking chamber.

4. A convection oven as in claim 1 including a flue passage formed in said top wall, said top wall including an opening near the front of said cooking chamber communicating with said flue passage.

5. A convection oven as in claim 1 wherein said means for delivering a premixed supply of air and fuel gas to said burner comprises a blower having first and second openings for admitting air and fuel gas, a supply of fuel gas connected to said blower, and a flow tube connecting said blower and said burner.

6. A convection oven as in claim 1 wherein said burner is positioned at the rear of said cooking chamber and comprises a burner shell and a perforated ceramic element mounted in the open end of said shell facing said first opening, said shell having an opening behind said ceramic element for admitting said premixed supply of air and fuel gas.

7. A convection oven as in claim 6 wherein the centers of said burner, said first opening of the baffle, and said blower assembly are aligned along a common axis.

8. A convection oven as in claim 7 wherein said blower assembly includes a ring containing a plurality of centrifugal impeller blades, said ring disposed radially outward of said burner shell.

9. A convection oven as in claim 8 wherein said shield is insulated from said shaft and comprises a thin metal bowl shaped to guide said combustion gases and cooking gases into said impellor blades.

10. A convection oven comprising:

walls forming an enclosed oven space, said walls including a top wall, a bottom wall, a rear wall, a front wall, and two opposed side walls;

a substantially vertical baffle near the rear of said oven space and dividing said oven space into a cooking chamber and a blower chamber, said baffle having top and bottom edges defining gaps between said edges and the top and bottom walls, respectively, of said oven, said baffle having an opening for flow of gases from said cooking chamber to said blower chamber;

a burner positioned in said cooking chamber adjacent to said opening of the baffle and aligned with the center thereof;

a blower assembly positioned in said blower chamber, said blower assembly including a fan operable to draw cooking gases from said cooking chamber into said blower chamber, to mix said cooking gases with combustion products from said burner, and to recirculate a mixture of combustion products and cooking gases through gas into the cooking chamber;

said burner including a burner shell having an open end facing said blower assembly and a perforated element mounted in said open end of the shell, said burner operable to fire combustion products directly into the center of said fan of the blower assembly;

means for delivering a premixed supply of air and fuel gas to said burner shell for passage through said perforated element; and an igniter adjacent to said perforated element.

11. A convection oven as in claim 10 wherein said blower assembly includes a rotatable shaft to which a ring of centrifugal impeller blades is attached, and a bowl-shaped shield connected to an end of said shaft in said blower chamber, said shield positioned within said ring of blades and aligned with said burner.

12. A convection oven as in claim 10 wherein said means for delivering a premixed supply of air and fuel gas to said burner shell includes a combustion blower for pressurizing said air and fuel gas.

13. A convection oven as in claim 10 further including means for varying the speed of rotation of said fan.

* * * * *